United States Patent [19]

Zunkel et al.

[11] 4,386,446

[45] Jun. 7, 1983

[54] DOOR CLOSER

[75] Inventors: Richard L. Zunkel, Princeton; George S. Nimee, Spring Valley, both of Ill.

[73] Assignee: Schlage Lock Company, San Francisco, Calif.

[21] Appl. No.: 240,076

[22] Filed: Mar. 3, 1981

[51] Int. Cl.[3] ..... E05F 3/00

[52] U.S. Cl. ..... 16/58; 16/DIG. 21

[58] Field of Search ..... 16/49, 51, 52, 58, 82, 16/DIG. 9, DIG. 17, DIG. 21; 49/137, 352

[56] References Cited

U.S. PATENT DOCUMENTS

| | | | |
|---|---|---|---|
| 1,711,879 | 7/1930 | Dowd et al. | 16/DIG. 21 |
| 2,940,111 | 6/1960 | Patriquin | 16/DIG. 9 |
| 3,449,789 | 6/1969 | Russell et al. | 16/DIG. 9 |
| 4,115,897 | 9/1978 | Zunkel | 16/49 |

FOREIGN PATENT DOCUMENTS

| | | | |
|---|---|---|---|
| 219450 | 1/1962 | Austria | 16/82 |
| 381556 | 10/1964 | Switzerland | 16/82 |

*Primary Examiner*—Paul A. Bell
*Attorney, Agent, or Firm*—Lothrop & West

[57] ABSTRACT

A door closer for regulating the movement of a door panel with respect to its frame has a body enclosing a chamber and an adjacent cylinder having a head. A piston is reciprocable in the cylinder toward and away from the head and in accordance with the door panel motion. A spring in the chamber urges the piston toward the head. A duct through the piston controlled by a check valve permits liquid flow from the chamber to the cylinder, but not vice versa. A passage in the body extends between the cylinder, near the head, and the chamber. In that passage near the head is a throttle valve for restricting liquid flow, and in the passage near the chamber is a bypass valve for restricting liquid flow and for permitting increased flow under increased liquid pressure. There is also a bore in the body extending between the passage intermediate the throttle valve and the bypass valve and an adjacent part of the cylinder traversed by the piston.

2 Claims, 4 Drawing Figures

DOOR CLOSER

BRIEF SUMMARY OF THE INVENTION

In the general installation of door closers, there is a panel which is movable with respect to its frame. Sometimes this is a pure sliding movement, but normally it is a hinged or pivoting movement. The closer is a spring-actuated device connected to the panel and to the frame for impelling the panel into its closed, and usually latched, position. A spring alone produces too erratic an action, and so there is also normally included a hydraulic dashpot operating through bleed apertures which are variable so that portions of the door panel closure movement can be damped and thus produce a proper and acceptable panel operation. While under many circumstances such an arrangement is in itself entirely satisfactory, in this instance there are provided special means, such as a regulating valve, to vary the mode of operation of such a structure.

Objects of the invention are to provide a door closer construction in which the closure mechanism includes a way of permitting extra force on the door panel to be effective in closing the door in at least some portion of its closing movement; to provide a door closer construction in which the closure regulating mechanism will permit the use of extra force at some times; and to provide an improved door closer.

DETAILED DESCRIPTION

Figure 1:
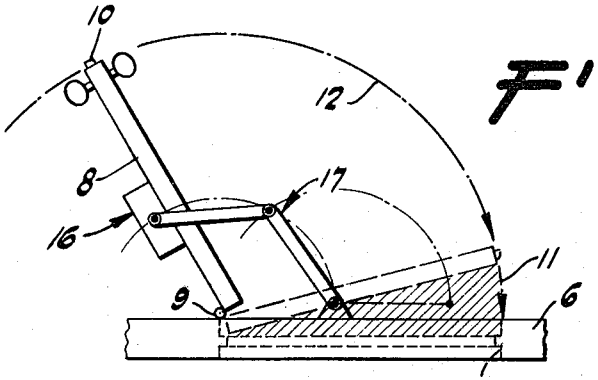
FIG. 1 is a diagrammatic or schematic view from above showing the interrelationship of a door frame, a door panel, and the closer mechanism of the present invention.

While the door closer of the invention is capable of installation under widely different circumstances and on widely different door constructions, it has successfully been incorporated in a standard installation as shown herein. In such an installation there is a frame 6. This most often is a wall having an opening 7 therein serving as a door opening and in connection with which there is provided a door panel 8 connected to the wall by hinges 9 or the like, so that the door panel can be swung through a relatively large arc for opening and closing purposes. Pursuant to the present invention, that arc is subdivided into two portions, one of which, a portion 11 near closure, is relatively small in angular extent, and the remaining portion 12, away from closure and toward full opening, is relatively great. A latching lock 10 is usually provided in the standard way.

While the door closer mechanism can be variously installed, it is currently illustrated as shown with a cylinder body 16 mounted on the door panel 8 and a toggle linkage 17 connecting the mechanism within the body with the door frame 6, so that a shaft 18 carried in the body 16 is rotated in accordance with the relative angular movement between the frame 6 and the panel 8. The shaft 18 is appropriately journalled in the body 16 and between its ends carries a gear 19 disposed in a chamber 21 in the body and through which the shaft 18 passes. The gear 19 meshes with a rack 22 on a rack bar 23 joining a piston 24 having a passage 25 therethrough and a piston 26. The pistons are spaced apart, but both engage the interior surface of a cylinder 27 formed within the body 16 and extending therethrough. The piston 24 is in contact with a compression spring 28 held in position by an end plug 29 screwed into one end of the body and closing that end of the cylinder. The other piston 26 is utilized in the control of the structure and reciprocates in the cylinder 27, which is closed at the other end by a head 31.

Figure 2:
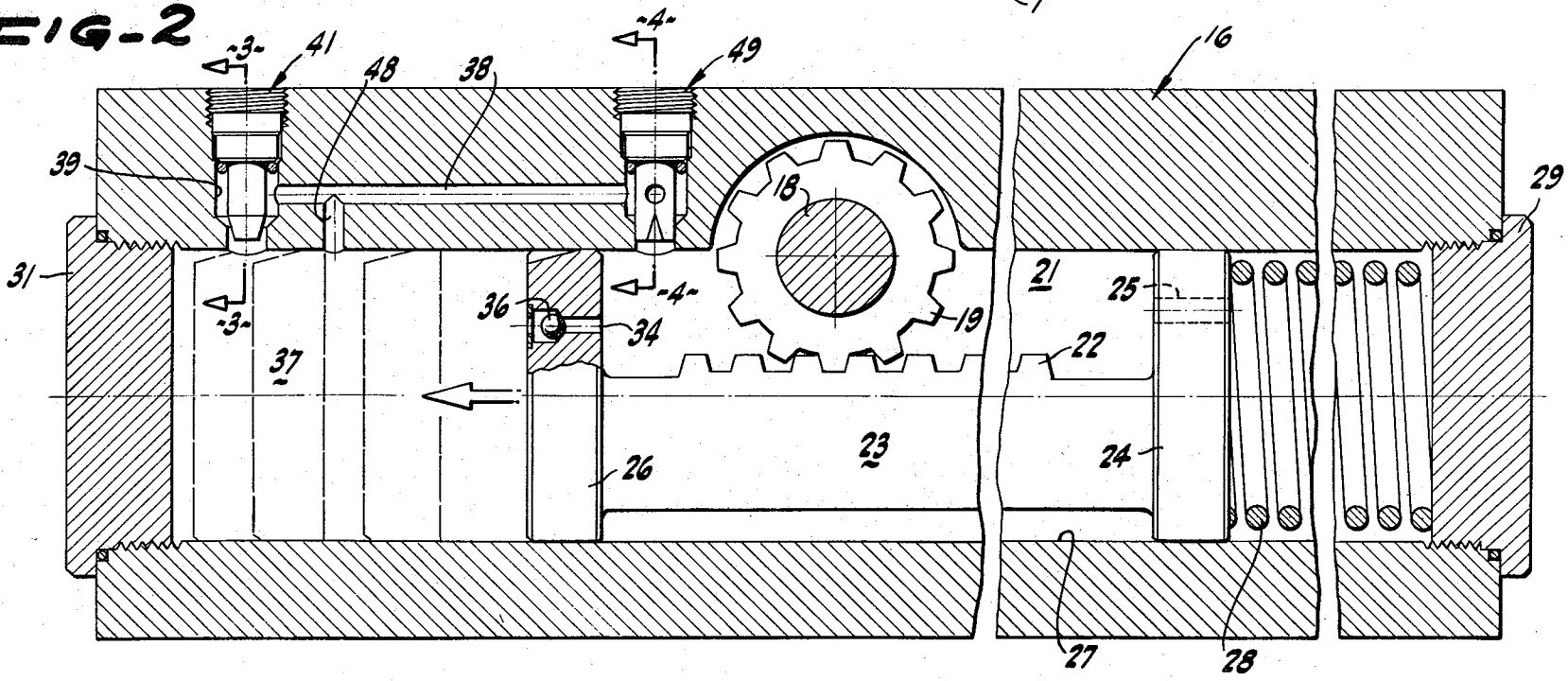
FIG. 2 is a cross-section on an axial plane through a door closer mechanism constructed in accordance with the invention.

As part of the means for controlling the motion of the closer and of the door panel, the interior of the closer is filled with an appropriate hydraulic fluid, such as a lubricating oil. Movement of the piston 26 causes displacement of the oil, and for that reason and for one direction of motion the piston 26 is particularly provided with a duct 34 in which is seated a check valve 36. During motion of the piston 26 from right to left in FIG. 2, the check valve is closed, but piston motion from left to right in FIG. 2 is accompanied by unseating of the valve ball 36, and there is flow of oil from the chamber 21 into the closer volume 37. This is a variable volume defined by the cylinder wall itself and by the piston 26 and the head 31. Thus both the chamber 21 and the cylinder 37 are variable in volume, depending in large part upon the movement of the piston 26.

In accordance with the invention, not only is there a provision for liquid passage through the piston 26 via the duct 34, but there is also a comparable or parallel flow path. Formed in the body 16 is a passage 38 extending parallel to the cylinder and at its head end merging with a cross bore 39 in the body and opening into the cylinder 37 near the head end thereof. In the bore 39 there is a throttle or regulating or latch speed valve 41. This is a body sealed in the cross bore by an O-ring 44 and engaging the body by means of threads 46, so that the axial position of the mechanism can be set. The lower end of the regulator 41 is tapered in at least one portion as at 47 and allows hydraulic flow between the cylinder volume 37 and the cross passage 38 in a regulated amount, depending upon the area of the portion 47. Thus, liquid can flow between the cylinder and the passage 38 in both directions as regulated by the area of the opening provided by the tapered portion 47.

There is an additional flow passage. In the body 16 there is a bore 48 extending between the cylinder 37 and the passage 38. The bore pierces the cylinder wall in an axial location that is well within the path of travel of the piston. Thus, for part of the piston travel the cylinder 37 is open through the bore 48 to the passage 38, whereas in the final movement of the piston in the vicinity of and toward the head 31, the piston is beyond the bore 48 and the bore cannot be effective to afford communication at that time between the cylinder and the passage 38. The piston preferably is contoured to afford the desired flow characteristics.

Figure 4:
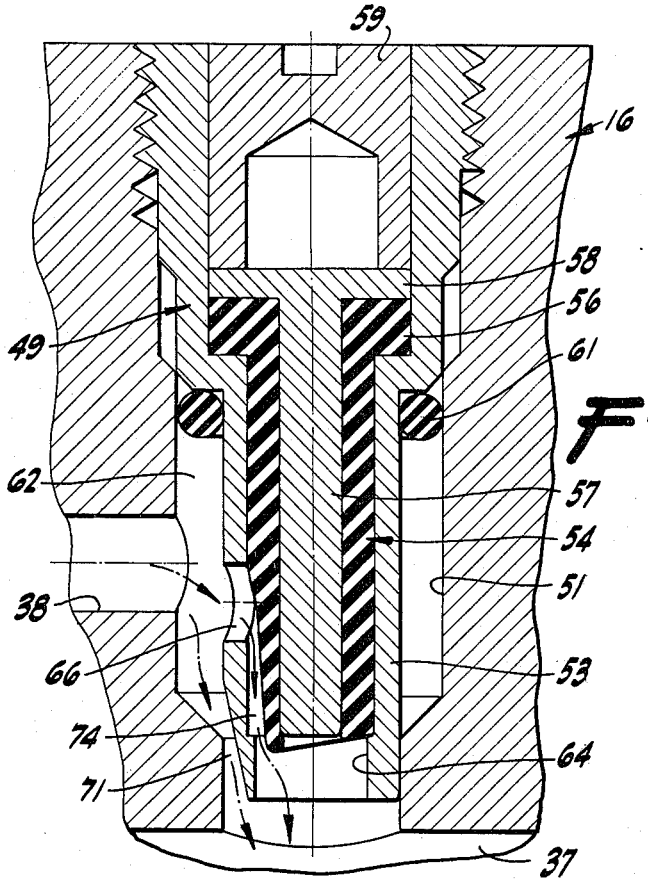
FIG. 4 is a cross-sectional view of a by-pass valve, the plane of section being indicated by the line 4—4 of FIG. 2, with certain parts being rotated for clarity of disclosure.
Figure 3:
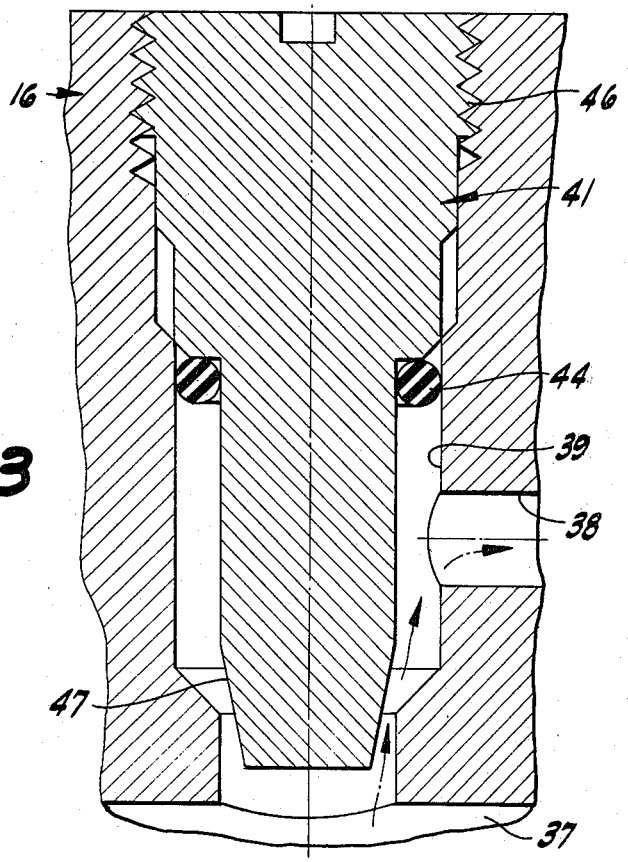
FIG. 3 is a cross-section to an enlarged scale of a latch speed valve, the section being taken on the line 3—3 of FIG. 2 and certain parts being rotated for clarity of illustration.

Flow through the passage 38 is controlled by a bypass valve 49 as shown in FIGS. 2 and 4. The bypass valve is disposed in a passage 51 in the body 16. This passage extends from the exterior of the body into the chamber 21 and is parallel to the bore in which the valve 41 is disposed. Included in the valve 49 is not only an outside tube 53 threaded into the closer body, but within such tube there is provided an elastomeric sleeve 54 having a flange 56. The sleeve in turn surrounds a central stem 57 of cylindrical form having a disc end 58. This is contacted and held in position by a plug 59 pressed into and so held in position in the body 16. An O-ring 61 prevents leakage between the body 53 and the outside. The passage 38 opens into a volume 62 surrounding the inward portion of the member 49. Not only is the sleeve 53 provided with an axial opening 64 communicating with the chamber 21, but likewise the wall is pierced by an aperture 66 open to the chamber 62 and so communicating with the passage 38.

In the operation of this device, the parts can be considered to start out in the relationship shown in FIG. 2, corresponding to the door panel 8 being in an open location. The force of the then-compressed spring 28 urges the rack bar 23 toward the left in FIG. 2 or toward "closed" position. Such movement causes the rack 22 to exert a corresponding rotary force on the gear 19 and thus through the linkage 17 tends to move the panel 8 toward closed position. This movement of the rack bar 23 likewise correspondingly translates the piston 26 to the left in FIG. 2. The piston motion tends to dislodge liquid from the cylinder volume 37, but there is no longer a passageway through the duct 34 since this direction of motion is accompanied by a seated position of the check valve 36. The trapped cylinder liquid cannot flow through the throttle valve 41 or through the passage 47 into the passage 38, as the pressure in the chamber 39 and the chamber 37 is the same. Thus there is no imbalance which would cause the fluid to move. That means that the speed of movement of the closer toward the left is not affected by the throttle valve 41 when the piston 26 is in the initial portion of the closing movement.

But while the piston 26 is only in the initial portion of its closing movement, there is liquid flow through the bore 48 into the passage 38, and this passage 38 is substantially unrestricted and is generally made somewhat larger than the passageway 47. That means that a large part of the flow out of the cylinder 37 during initial closing movement is through the bore 48 into the passage 38. Hence, during this portion of the piston movement there is no restriction on the rate of movement of the piston, at least by the passage 47 and the passage 48. Regulation by the throttle valve 41 is therefore of no consequence during the initial closing movement of the piston 26, but in the final closing movement, the piston 26 overrides the bore 48 and the flow is throttled by the portion 47, a substantial restriction.

Flow from the passage 38 back to the chamber 21 is particularly regulated by the bypass valve 49 as shown in FIG. 4. Flow is into the valve chamber 62 from the passage 38 and under ordinary circumstances is merely through a tube slot 71 into the chamber 37. This is a relatively limited amount. However, special means are provided for operation at an increased pressure to bypass more fluid. For that reason, the aperture 66 through one wall of the tube 53 allows fluid pressure to act against the elastomeric sleeve 54. Thus, when the flow tends to be sufficient to cause a pressure increase, that increased pressure displaces or deforms the elastomeric sleeve away from the aperture 66 and toward the stem 57 and allows liquid to flow parallel to the opening 71 and through a channel 74 into the chamber 21. When the pressure in the passageway 38 drops, then the opening 66 and the channel 74 are closed and there is a resumption of its normal shape by the elastomeric sleeve 54. Flow is then confined to the passage 71.

It occurs in some installations that the panel 8 is urged toward closed position by a potentially excessive manual force. When that occurs within the range 12, the piston 26 has not quite reached a position to overlie and block the bore 48. The extra force simply puts extra pressure on the liquid, which then causes the elastomeric sleeve 54 to deform, as shown in FIG. 4, to allow faster closing of the panel than the usual closer mechanism itself would permit. However, as soon as the panel moves in the range 11 near the latching position, the piston 26 by that time has overridden the bore 48. No longer can the liquid pass through that bore 48 and be governed solely by the setting of the bypass valve 49. Rather, the bore 48, having been traversed or overridden, leaves the throttle valve 41 as the only means of escape of liquid from the then-diminished volume cylinder. Under those conditions, the throttle valve 41, having a set adjustment or minimum open position, definitely limits the amount of flow area for the discharging liquid and governs to a set rate the final closing movement of the panel despite a large exterior, manual force imposed thereon. In this way the latching mechanism is well protected against a slam or undue overloading.

Thus, there is provided within the normal compass or frame of a door closer a mechanism which permits relatively free use of additional force during a large part of the closing path of the door panel but always ensures that the final closing and latching movement of the door panel is limited to a definite maximum amount.

We claim:

1. A door closer for use with a door frame and a door panel movable through a defined path relative to said frame comprising a cylinder body having a chamber and a cylinder, a head closing one end of said cylinder, a piston reciprocable in said cylinder, means interconnecting said piston and said panel for moving said piston in said cylinder toward and away from said head in accordance with the movement of said panel relative to said door frame, a spring for urging said piston toward said head, a duct for allowing fluid to bypass said piston and flow from said cylinder into said chamber, a check valve in said duct, means in said body defining a passage shunting said piston in all positions thereof and extending between said cylinder and said chamber, a throttle valve in said passage near said head, a bore in said body extending between and open to said passage and open to a portion of said cylinder swept by said piston, means in said body defining a bypass channel open to said passage and to said cylinder, a tube in said bypass channel and open at one end to said cylinder, means closing the other end of said tube, a stem disposed concentrically within said tube, means defining an aperture in a wall of said tube affording access between said bypass channel and the interior of said tube, and a sleeve in said tube and surrounding said stem and adapted when unstressed to overlie said aperture and adapted under pressure in said aperture to move radially and axially of said stem to afford communication between said aperture and said cylinder.

2. A door closer as in claim 1 in which said sleeve is an elastomeric member subject to radial and axial deformation in accordance with different fluid pressures.

* * * * *